US005375272A

United States Patent [19]

Mikol

[11] Patent Number: 5,375,272

[45] Date of Patent: Dec. 27, 1994

[54] TOP MOUNT FAUCET AND SINK ASSEMBLY

[75] Inventor: Erwin F. Mikol, Westlake, Ohio

[73] Assignee: Moen Incorporated, Elyria, Ohio

[21] Appl. No.: 158,432

[22] Filed: Nov. 29, 1993

[51] Int. Cl.[5] ..... E03C 1/042

[52] U.S. Cl. ..... 4/695; 137/356; 137/359; 285/206

[58] Field of Search ..... 4/675, 676, 677, 678, 4/695; 285/206; 137/356, 357, 359, 606

[56] References Cited

U.S. PATENT DOCUMENTS

| | | | |
|---|---|---|---|
| 3,427,049 | 2/1969 | Politz | 4/695 X |
| 4,186,761 | 2/1980 | Guarnieri | 4/695 X |
| 4,281,857 | 8/1981 | Randall | 285/206 X |
| 4,290,445 | 9/1981 | Turner | 4/695 |
| 4,502,165 | 3/1985 | Szemeredi et al. | 4/695 |
| 4,553,277 | 11/1985 | Duncan | 137/359 X |
| 4,848,395 | 7/1989 | Krippendorf | 4/695 X |

*Primary Examiner*—Charles E. Phillips

*Attorney, Agent, or Firm*—Dorn, McEachran, Jambor & Keating

[57] ABSTRACT

A top mount faucet and sink assembly includes a faucet which has a pair of exteriorly threaded legs. The sink has a pair of mounting openings of a size and spacing to receive the faucet legs for attaching the faucet to the sink. Each of the sink openings has a wall with a thread formed therein. The pitch of the sink wall thread is different than the pitch of the thread on the mounting legs. There are a pair of locking elements, one for each leg, each locking element having an opening with a thread that matches the thread on the faucet mounting legs. Each locking element further having an exterior surface with a thread that matches that on the sink wall. In assembly of the faucet to the sink, the locking elements are first positioned on the threaded legs and turned up against the bottom of the faucet. The faucet is then positioned on the sink with the legs extending through the sink openings and the locking elements are engaged with the sink opening wall threads. Turning of the locking elements draws the faucet snugly down upon the top of the sink.

12 Claims, 2 Drawing Sheets

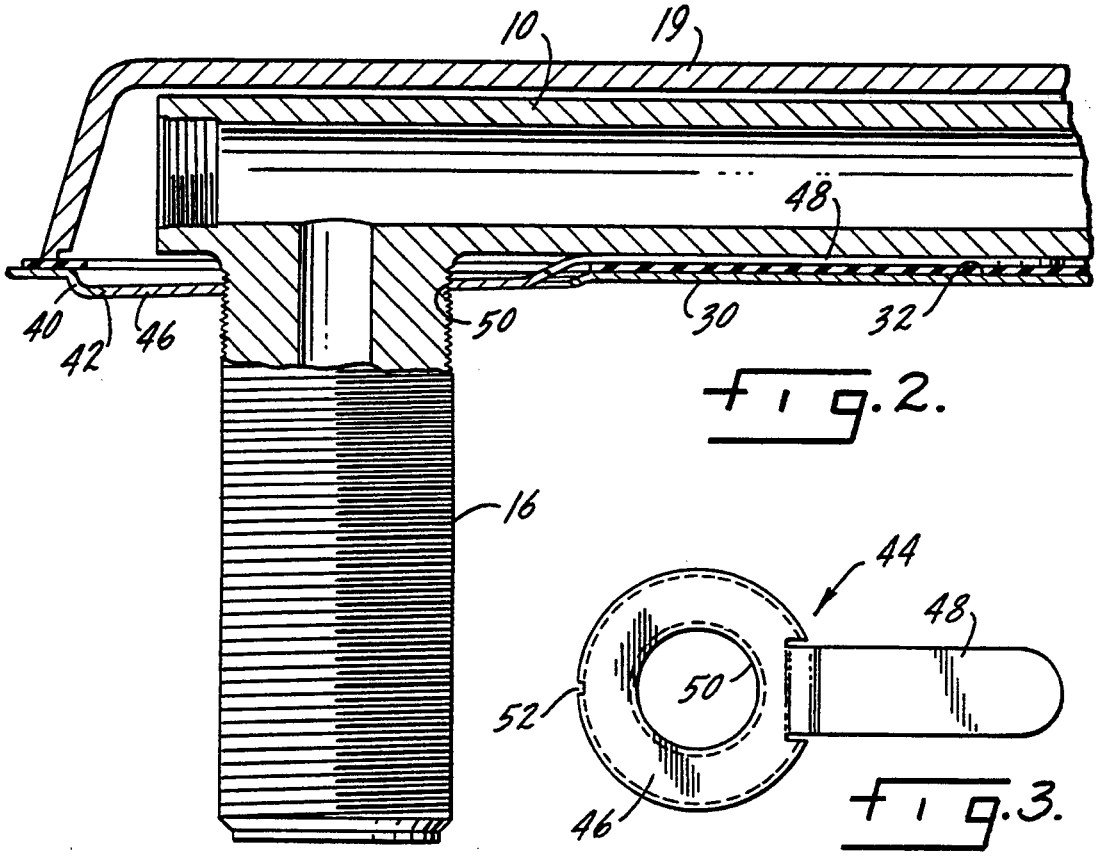
Fig. 2.
Fig. 3.
Fig. 4.
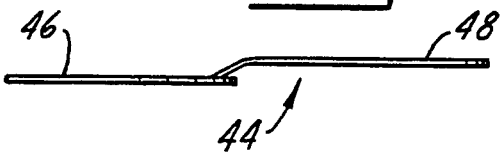

TOP MOUNT FAUCET AND SINK ASSEMBLY

THE FIELD OF THE INVENTION

The present invention relates to top mounted faucet and sink assemblies and more particularly to such an assembly in which the faucet may be completely mounted and dismounted from the top of the sink. Existing faucets require mounting by nuts which are threaded on faucet legs, with the nuts being located below the sink deck. If a faucet is attached to the sink after the sink is installed, a special tool such as a basin wrench must be used to mount or dismount the faucet. The present invention eliminates the need for such a tool and the need to work in cramped quarters beneath the sink. The entire mounting operation may be done from above the sink.

SUMMARY OF THE INVENTION

The present invention relates to a faucet and sink assembly in which the faucet is mounted to the sink by an installer working only from above the sink.

A primary purpose of the invention is a top mount faucet and sink assembly eliminating the need for special tools and for the necessity of the installer to work within the cramped quarters beneath an installed sink.

Another purpose of the invention is a top mount faucet and sink assembly utilizing differential thread pitches on associated parts of the faucet and sink to draw the faucet down snugly upon the top of the sink prior to the installation of the faucet escutcheon.

Another purpose of the invention is to provide a simplified mounting for a faucet which may be installed and removed entirely from above the sink.

Another purpose is a top mount faucet and sink assembly eliminating the need for special tools.

Other purposes will appear in the ensuing specification, drawings and claims.

BRIEF DESCRIPTION OF THE DRAWINGS

The invention is illustrating diagrammatically in the following drawings wherein:

FIG. 2 is an enlarged partial section, illustrating the cooperation between the faucet mounting legs and the sink threaded openings;

FIG. 3 is a top view of the faucet locking element; and

FIG. 4 is a side view of the locking element of FIG. 3.

DESCRIPTION OF THE PREFERRED EMBODIMENT

Figure 1:
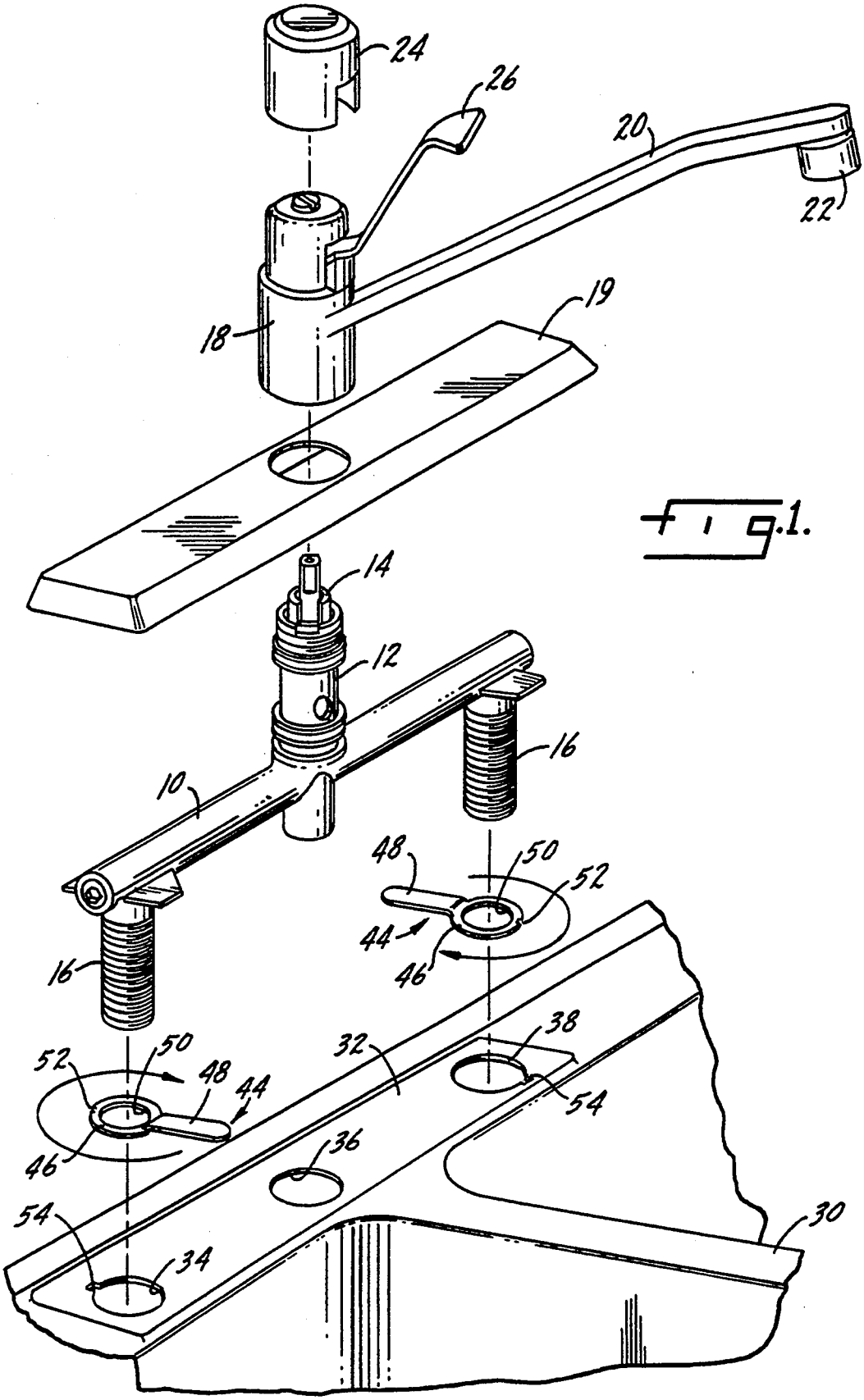
FIG. 1 is an exploded perspective of the top mounted faucet and sink assembly of the present invention.

Traditionally, a faucet may be mounted to a sink either prior to or after the sink is positioned in its desired location. If the faucet is mounted before sink installation, it does not matter if access to the area beneath the sink is required for mounting the faucet. However, in those instances in which the sink is installed, it is conventional in the plumbing trade for the faucet to be placed upon the sink and for the faucet installer to then use a special tool, normally a basin wrench, and to thread bolts on the mounting legs of the faucet from beneath the sink. This requires the installer to work in cramped quarters and to use specialized tools. The situation is even more difficult when the sink is to be dismounted or removed, as normally the area beneath the sink not only has other plumbing fittings and fixtures, but is often a storage place for various kitchen and bathroom accessories. The present invention eliminates any need to have access to the area beneath the sink for mounting a faucet to the sink. The faucet is mounted entirely from the area above the sink.

In FIG. 1 a typical kitchen faucet of the type sold by Moen Incorporated, the assignee of the present application, has a faucet body indicated generally at 10, with the body having an upstanding barrel 12 which holds a conventional mixing cartridge 14. The illustrated example is a single lever mixing faucet, although the essential characteristics of the invention are equally applicable to other types of faucets such as two handle faucets. The body 10 includes a pair of exteriorly threaded mounting legs 16 which extend downwardly from opposite ends of the body 10 and in some applications may also be the hot and cold water waterways to convey water into the body 10 to the mixing cartridge 14.

When the faucet is fully installed, the barrel 12 will be covered by a hub 18 from which a spout 20 extends outwardly to the area over the sink. An aerator 22 may be attached at the end of the spout. An escutcheon 19, a removable cap 24 and a lever 26, movement of which is effective to both rotate and reciprocate the mixing cartridge 14 to vary the volume and temperature of the water discharged through the spout, complete the faucet assembly.

A sink is indicated generally at 30 and in this instance is a two compartment sink. There are three mounting openings in the sink deck 32, the openings being indicated at 34, 36 and 38. The openings 34 and 38 accommodate the threaded mounting legs 16, whereas, the opening 36 will accommodate an extension of the central barrel 12, and in some installations there may be a conduit coming down from the barrel 12 to the sink spray. As shown particularly in FIG. 2, the sink openings 34 and 38 each have a wall 40, with each wall having a thread 42. The thread may only be a single turn, but nevertheless, there is a thread form in the wall 40. As indicated above, the mounting legs 16 have an exterior thread thereon. The pitch of the thread on the legs 16 is not as coarse as the pitch of the thread 42 on the wall 40. As an example, but without being limited thereto, the thread on the mounting legs 16 may be $\frac{1}{2}$-14 NPSM-2B and the thread 42 on the sink opening 40 may be $1\frac{1}{4}$-11.5 NPSM-2A.

A locking element is shown in FIGS. 3 and 4 and is indicated generally at 44. The locking element includes a body portion 46 and a handle 48. As shown particularly in FIG. 4, the handle 48 is vertically offset from the plane of the body portion 46. The body portion has an interior circular opening 50 which is threaded and with a thread that matches that on the mounting legs 16. The exterior of the body portion 46 is circular and has a thread which matches that of the thread 42 on the wall 40. In order to locate each locking element in a position so that the threads thereon coact with the threads in the sink wall opening, there are alignment notches 52 on each locking element and 54 in the sink deck openings 34 and 38.

In mounting the faucet to the sink by use of the described locking elements, the first step is to turn the locking elements onto the mounting legs 16 and rotate these elements so that they are all the way up on the mounting leg threads. The faucet is then placed upon the sink deck with the legs extending through the openings 34 and 38 and with the locking elements being seated upon the sink deck 32. The notches 52 and 54 are in alignment so that the locking element handles are disposed as illustrated in FIG. 1, each extending in opposite directions and generally outwardly from the faucet body 10. In this position the threads on the locking elements and sink wall opening are positioned for threaded engagement. Each handle is then rotated through approximately 270° or three-quarters of a full turn, with the locking elements being turned in a clockwise direction. Turning of the locking elements will cause them to rotate both relative to the threaded mounting legs and the thread on the sink opening walls. However, because of the differential pitch between these threads, and the fact that the pitch on the sink opening walls is coarser than that on the mounting legs, the faucet body 10 will be drawn snugly down upon the sink deck. Note FIG. 2. When the handles have been turned through the desired three-quarters of a turn, both handles will be pointing toward each other and pointing toward the center of the faucet. At this point the escutcheon 19 may be placed over the sink body and the escutcheon when so positioned, as shown in FIG. 2, will mask not only the sink body, but also the locking elements whose handles will be within the confines of the escutcheon. After the escutcheon is so mounted, the remaining portions of the faucet exterior, the hub 18 and its cap 24, may be positioned in the customary manner.

Of importance in the invention is the fact that the entire mounting of the faucet to the sink takes place from above the sink. The locking elements are hidden from view once the faucet is totally assembled. The differential pitch of the threads on the two parts of the locking elements are effective to snugly draw the faucet body down upon the sink deck. To dismount the faucet, the reverse operation takes place, with the handles being turned to release the cooperating threads on the locking elements and the sink deck.

Whereas the preferred form of the invention has been shown and described herein, it should be realized that there may be many modifications, substitutions and alterations thereto.

The embodiments of the invention in which an exclusive property or privilege is claimed are defined as follows:

1. A top mount faucet and sink assembly including a faucet having a pair of mounting legs, a sink having a pair of mounting openings of a size and spacing to receive said mounting legs for attaching the faucet to the sink, each of said openings having a wall with a thread formed therein, and a pair of locking elements, one for each leg, engaging means for attaching a locking element to each leg, each locking element having a threaded exterior, with the pitch of the exterior thread matching the pitch of the opening wall thread, in assembly of the faucet to the sink, the locking elements are first engaged on the mounting legs, the faucet is then positioned of the sink, with the mounting legs extending through the sink openings, and the locking elements engaged with the sink opening wall thread, turning of the locking elements locking the legs to the sink.

2. The faucet and sink assembly of claim 1 characterized in that the means for attaching each locking element to its associated leg includes a thread on the exterior of the mounting leg, an opening in each locking element, with the opening having a wall with a thread matching that of its associated mounting leg.

3. The faucet and sink assembly of claim 1 characterized in that said faucet includes an outer cover, said cover concealing said locking elements when the cover is positioned on said faucet.

4. A top mount faucet and sink assembly including a faucet having a pair of exteriorly threaded legs, a sink having a pair of mounting openings of a size and spacing to receive said exteriorly threaded legs for mounting the faucet to the sink, each of said sink openings having a thread formed in a wall thereof, with the pitch of the sink wall thread being different than the pitch of the thread on the legs, and a pair of locking elements, one for each leg, each locking element having an opening with a thread that matches the thread on the faucet legs, each locking element having an exterior surface with a thread that matches that on the sink wall, in assembly of the faucet to the sink, the locking elements are first threaded onto the threaded legs, the faucet is then positioned on the sink with the legs extending through the sink openings and the locking elements engaged with the sink opening wall threads, turning of the locking elements locking the legs and thus the faucet to the sink.

5. The faucet and sink assembly of claim 4 characterized in that the threaded legs form the waterways for the faucet.

6. The faucet and sink assembly of claim 4 further characterized in that the pitch on the locking element exterior thread is coarser than the pitch on the locking element opening thread such that a turning of the Locking elements draws the faucet down toward the sink.

7. The faucet and sink assembly of claim 4 characterized by alignment means on each locking element and on each sink opening to provide for positioning of the locking elements to initiate threaded cooperation between each locking element and the thread on the sink opening wall.

8. The faucet and sink assembly of claim 7 further characterized in that said alignment means includes notches in each locking element and a notch in the wall of each sink opening.

9. The faucet and sink assembly of claim 4 further characterized in that each locking element has an outwardly extending handle.

10. The faucet and sink assembly of claim 9 characterized by an escutcheon positioned on top of the faucet and overlying the threaded legs and sink openings, with said locking element handles being positioned inside of the exterior of said escutcheon when the handles are in locking position.

11. The faucet and sink assembly of claim 9 further characterized in that each handle is vertically offset from a portion of the locking element having the exterior thread to permit rotation of the locking elements without initial contact between the handles and the sink.

12. A top mount faucet and sink assembly including a faucet having at least one mounting leg, a sink having at least one mounting opening of a size to receive said at least one mounting leg for attaching the faucet to the sink, said at least one sink opening having a wall with a thread formed therein, said at least one mounting leg being exteriorly threaded, and at least one locking element having an opening with a thread that matches the thread on the at least one faucet leg, said at least one locking element having an exterior surface with a thread that matches that on the at least one sink opening wall, the pitch of the thread on the locking element exterior being coarser than that of the thread on the locking element opening, in assembly of the faucet to the sink, the at least one locking element is first positioned on the at least one mounting leg, the faucet is then positioned on the sink with the at least one leg extending through the at least one sink opening and the at least one locking element being engaged with the at least one sink opening wall thread, turning of the at least one locking element locking the at least one mounting leg to the sink.

* * * * *